US006776571B2

(12) United States Patent
Riffle

(10) Patent No.: US 6,776,571 B2
(45) Date of Patent: Aug. 17, 2004

(54) FORK ATTACHMENT FOR BACKHOE

(75) Inventor: Lonnie Riffle, Geneva, OH (US)

(73) Assignee: James M. Lemieux, Jefferson, OH (US)

( * ) Notice: Subject to any disclaimer, the term of this patent is extended or adjusted under 35 U.S.C. 154(b) by 0 days.

(21) Appl. No.: 09/974,166

(22) Filed: Oct. 9, 2001

(65) Prior Publication Data

US 2003/0068217 A1 Apr. 10, 2003

Related U.S. Application Data

(60) Provisional application No. 60/239,763, filed on Oct. 12, 2000.

(51) Int. Cl.[7] ..... E02F 9/00

(52) U.S. Cl. ..... 414/722; 414/912; 37/468; 37/903

(58) Field of Search ..... 414/722, 723, 414/724, 912; 37/405, 903, 468

(56) References Cited

U.S. PATENT DOCUMENTS

| | | | | |
|---|---|---|---|---|
| 2,473,505 A | | 6/1949 | Brock | |
| 2,802,584 A | * | 6/1957 | Przybylski | 414/685 |
| 2,980,271 A | | 4/1961 | Ulinski | |
| 3,312,361 A | | 4/1967 | Foster | |
| 3,356,241 A | | 12/1967 | Varilek | |
| 3,421,642 A | | 1/1969 | Carter | |
| 3,667,633 A | | 6/1972 | Cappella | |
| 3,786,948 A | | 1/1974 | Golden | |
| 3,795,331 A | | 3/1974 | Guest | |
| 3,817,567 A | | 6/1974 | Lull | |
| 3,819,078 A | | 6/1974 | Walsh | |
| 3,845,871 A | | 11/1974 | Dilillo et al. | |
| 4,013,182 A | | 3/1977 | Pratt et al. | |
| 4,125,952 A | | 11/1978 | Jennings | |
| 4,247,243 A | | 1/1981 | Carter | |
| 4,274,798 A | | 6/1981 | Guest | |
| 4,405,282 A | | 9/1983 | Carter | |
| 4,488,422 A | | 12/1984 | Wolf et al. | |
| 4,505,635 A | | 3/1985 | Shinoda et al. | |
| 4,517,755 A | | 5/1985 | Nicholson | |
| 4,561,199 A | * | 12/1985 | Lockwood | 414/724 X |
| 4,583,907 A | | 4/1986 | Wimberley | |
| 4,669,947 A | | 6/1987 | Frost | |
| 4,756,661 A | | 7/1988 | Smart | |
| 4,775,288 A | | 10/1988 | Dimitriu | |
| 4,804,309 A | * | 2/1989 | Risch | 414/723 X |
| 4,954,041 A | | 9/1990 | Dahlquist et al. | |
| 4,961,681 A | | 10/1990 | Threatt | |
| 4,986,722 A | * | 1/1991 | Kaczmarczyk et al. | 414/723 |
| 5,064,338 A | | 11/1991 | Lawrence | |
| 5,071,311 A | * | 12/1991 | Foster et al. | 414/724 |
| 5,073,077 A | | 12/1991 | Altman | |
| 5,125,788 A | * | 6/1992 | Stenger | 414/723 |
| 5,190,437 A | | 3/1993 | Perry | |
| 5,338,148 A | * | 8/1994 | Ronnblom | 414/723 X |
| 5,405,237 A | | 4/1995 | Oka | |
| 5,544,435 A | | 8/1996 | Somero | |
| 6,022,184 A | | 2/2000 | Friedland | |
| 6,056,503 A | | 5/2000 | Way et al. | |
| 6,065,926 A | | 5/2000 | Knapp | |
| 6,108,951 A | * | 8/2000 | Renfrow et al. | 414/723 X |

* cited by examiner

*Primary Examiner*—Donald W. Underwood
(74) *Attorney, Agent, or Firm*—D. Peter Hochberg; Sean Mellino; Katherine R. Vieyra

(57) ABSTRACT

The invention relates to affixing adapter plates to the back of commercially available forklift implements to enable the rapid connection of a forklift to the end of the hydraulic booms of backhoes. The attachment is accomplished either by substituting the bucket of the backhoe with the modified forklift or by engaging the modified forklift with a modified bucket connector which allows the forklift implement to be connected without removing the bucket.

8 Claims, 8 Drawing Sheets

FORK ATTACHMENT FOR BACKHOE

This application claims the benefit of Provisional Application No. 60/239,763 filed Oct. 12, 2000.

BACKROUND OF THE INVENTION

1. Field of the Invention

The present invention relates generally to methods for adapting and attaching a forklift implement to a backhoe supplied with a bucket. More particularly, the invention relates to adapter plates which can be attached to a forklift implement in order to quickly attach the forklift to a backhoe boom and to modifications to the bucket attachment of a backhoe to quickly attach the forklift implement without the need to remove the bucket.

2. Description of the Prior Art

There exist in the art many devices for operating forklifts or other implements attached to a backhoe, or for substituting implements on the booms of loaders. For example, U.S. Pat. No. 6,022,184 issued to Friedland discloses a method of attaching a forklift implement to the blade of a loader bucket by means, of attachment pads. The pads attached to the forklift implement can be raised or lowered by means of screws having a swivel surface which allows proper adaptation of the forklift implement to the blade of the bucket.

U.S. Pat. No. 6,065,926 issued to Knapp describes an adjustable fork tractor system. The objective of the invention is to disclose an adjustable fork that allows the lifting of loads of substantially different sizes.

U.S. Pat. No. 5,064,338 issued to Lawrence discloses an implement mounting apparatus for use with utility tractors, lawn and garden tractors, and riding mowers. The mounting apparatus allows the removable mounting and use of numerous attachments for performing multiple grounds maintenance, such as yard and lawn care, or the lifting of objects.

U.S. Pat. No. 5,405,237 issued to Oka discloses a leveling mechanism for maintaining the desired angle between the implement and the horizon of either a forklift or a front loader bucket. The device is to be utilized in a dual boom frontal loader mounted on a tractor.

U.S. Pat. No. 4,669,947 issued to Frost, and U.S. Pat. No. 4,405,282, and U.S. Pat. No. 4,247,243 issued to Carter disclose different methods of attaching a forklift to the bucket of a dual boom front loader.

U.S. Pat. No. 4,274,798 issued to Guest discloses yet another method for attaching a forklift to the bucket of a front-end loader.

U.S. Pat. No. 4,125,952 issued to Jennings discloses yet another method of converting the bucket of a front-end loader into a quasi forklift implement.

As shown by the prior art, many approaches and devices have been utilized to adopt certain categories of earth moving equipment to the utilization of a forklift. Most of the patents relate to the modification of dual boom front-end loaders for utilization or attachment of a forklift.

The present invention is aimed at achieving the rapid change, in a single boom backhoe, from a bucket to a forklift. The objective can be achieved by attaching two adapter plates to the back plate of a forklift implement. Said adapter plates are designed to engage directly to the typical receiver member of a single boom backhoe. Another way of achieving the objective is to affix a pair of adapter plates to both sides of the receiver member. The adapter plates attached to the receiver member are designed to engage directly with a rod affixed to the back of the forklift implement. This last approach allows the forklift implement to be attached to the backhoe without removing the bucket. Both approaches allow the modification of a backhoe from a bucket to a forklift rapidly by a single individual. Both embodiments represent a substantial improvement over equipment commercially available at the present time.

SUMMARY OF THE INVENTION

It is an object of the present invention to provide a rapid method of substituting the bucket of a single boom backhoe with a forklift implement.

It is another object of the present invention to modify a standard and commercially available forklift implement for easy attachment to the boom of a backhoe.

It is yet another object of the present invention to provide adapter plates that can be attached to commercially available forklift implement for easy attachment to the receiver member of the backhoe boom.

Still another object of the present invention is to provide an attachment method for a forklift implement to a backhoe boom without the need to remove the bucket.

It is a further objective of the present invention to attach the forklift implement to the backhoe boom and bucket without the need to utilize any tools.

Still another objective of the present invention is to provide a secure and stable attachment of the forklift implement to the backhoe boom and bucket without utilizing any fastening devices.

BRIEF DESCRIPTION OF THE DRAWINGS

FIG. 5(*a*) shows the receiver member of the backhoe ready to be coupled with the adapter plates of the forklift.

FIG. 5(*b*) shows the backhoe boom attached to the forklift implement.

DESCRIPTION OF THE PREFERRED EMBODIMENTS

Figure 1:
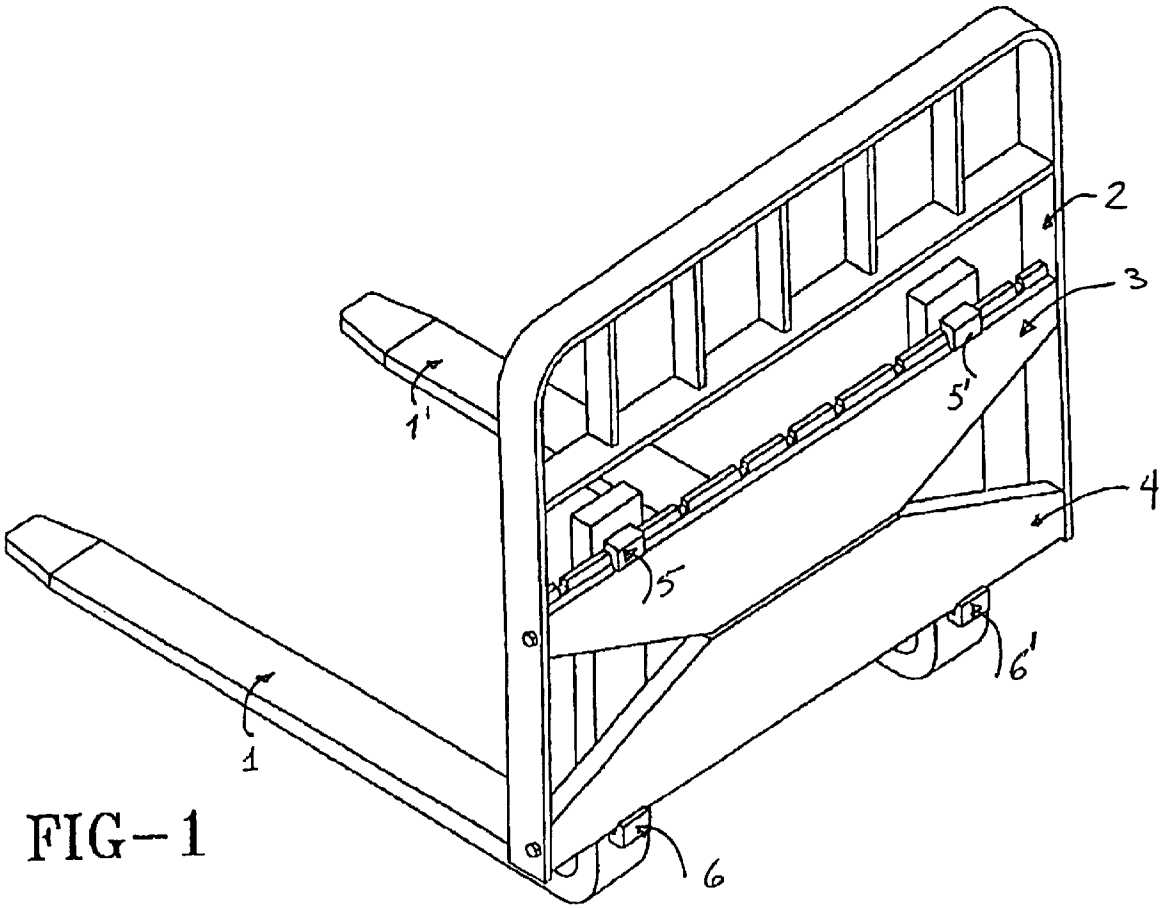
FIG. 1 is a perspective view of a commercially available forklift implement, including back plates and carriage.

FIG. 1 shows a commercially available forklift implement or attachment. The forklift implement comprises a set of tines 1 and 1' which is generally designed to fit underneath a load or a pallet. A back frame 2 supports a pair of upper and lower back plates 3 and 4 respectively. The back plates are fastened to the back frame by means of bolts or welded to said back frame. The tines are fastened to the back plates by means of upper and lower connection hooks 5 and 5' and 6 and 6' respectively. In a typical utilization, forklift back plates 3 and 4 are normally attached to the lifting portion of a forklift vehicle. In the present invention, the forklift implement is modified to accept a pair of adapter plates 7 and 7' of FIG. 2. The frontal portion of the adapter plates has plate enlargements 8 and 8' which are designed to be connected to back plates 3 and 4. Adapter plates 7 and 7' are fabricated from steel or other suitable metal and have sufficient thickness to support the weight of the forklift and the load. Enlargements 8 and 8' increase the thickness of the plates in the areas where they are to be attached to the upper and lower back plates. The increase in thickness reinforces the plates in the attachment area and improves the stability of the adapter plates in the horizontal plane.

Figure 2:
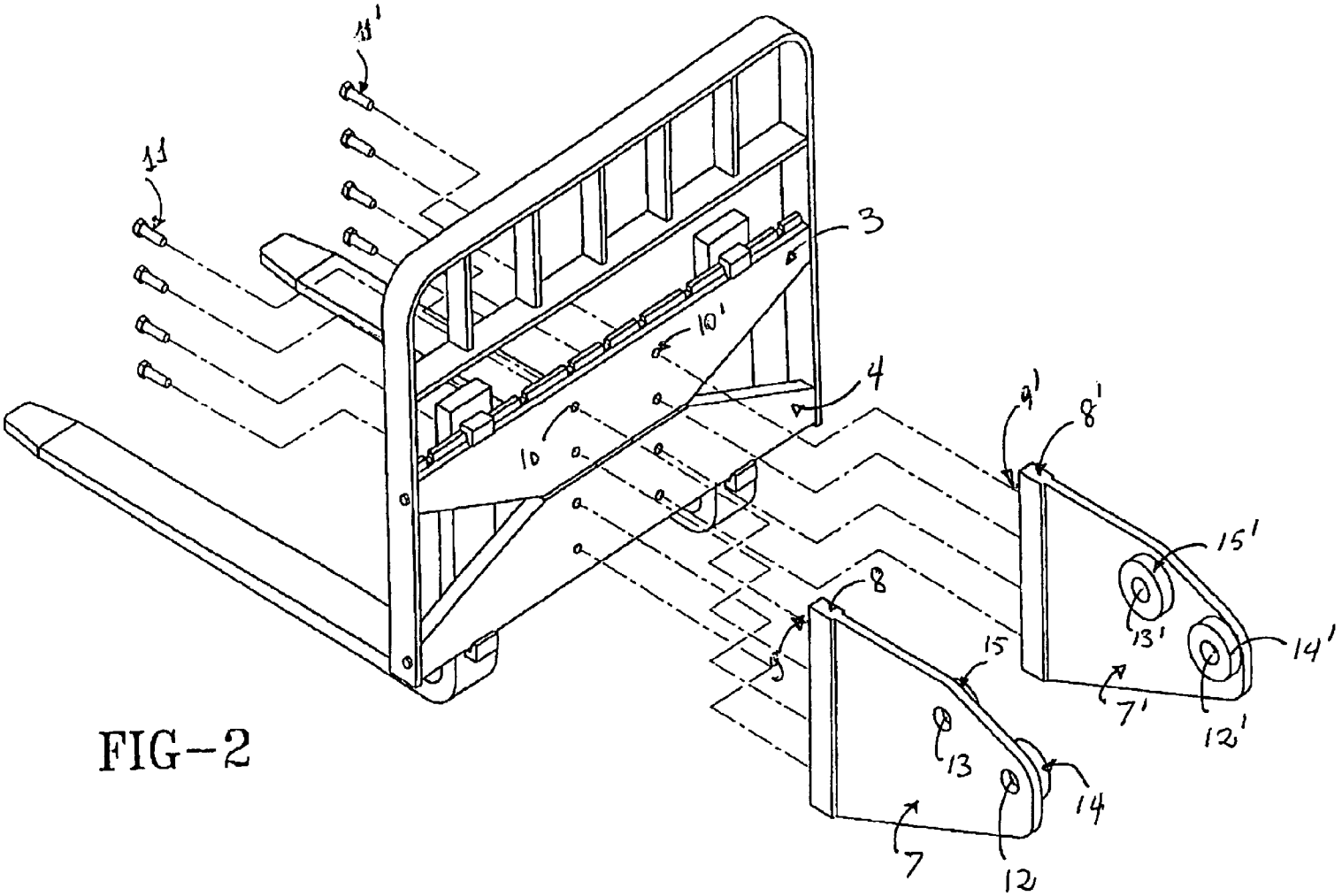
FIG. 2 is a perspective view of the forklift implement and the adapter plates to be affixed to the forklift implement.
Figure 3:
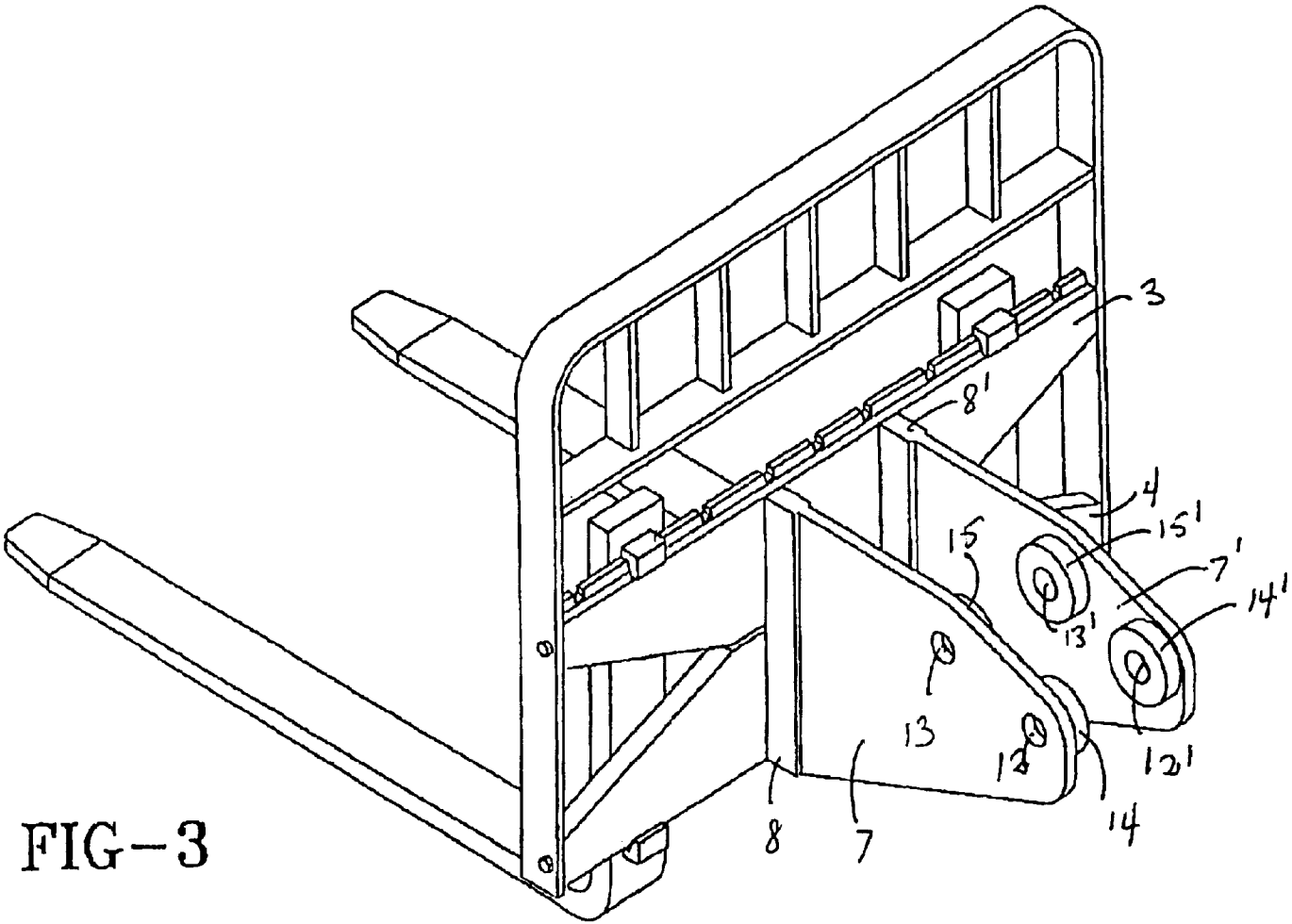
FIG. 3 is a perspective view of the forklift implement with the adapter plates attached.
Figure 4:
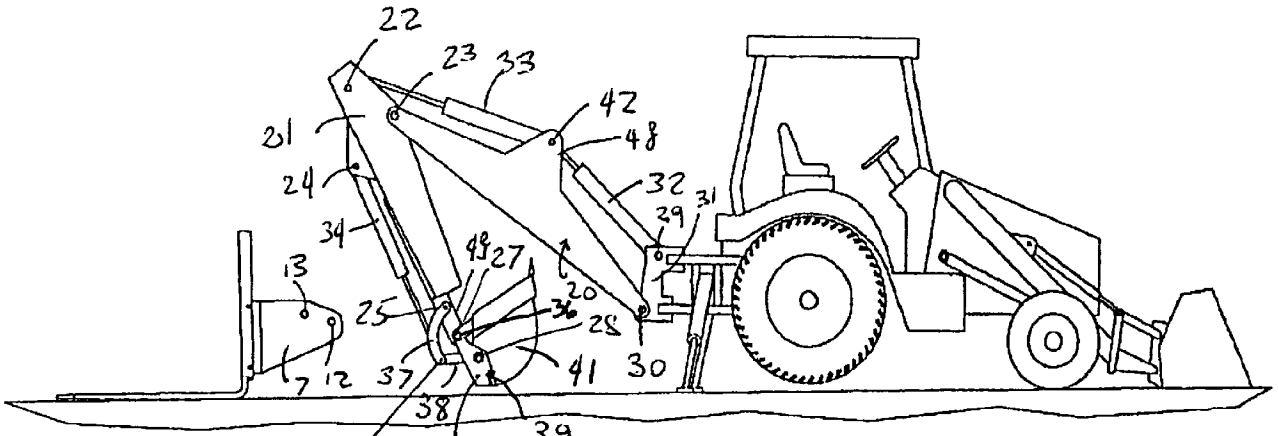
FIG. 4 is a lateral view of a tractor with front loader and backhoe implements.

Enlargements 8 and 8' comprise a plurality of bores, 9 and 9' which are perpendicular to the frontal face of plate enlargements 8 and 8'. The set of bores 9 and 9', in plate enlargements 8 and 8' are tapped to receive a corresponding pluralities of bolts 11 and 11'. A plurality of holes 10 and 10' are drilled in the upper back plate 3 and the lower back plate 4. The holes are vertically aligned and drilled to correspond and align with bores 9 and 9' in the plate enlargements 8 and 8'. As shown in FIG. 3, the adapter plates can thus be attached to the back of the forklift by connecting the adapter plates to the back plates of the forklift with bolts 11 and 11'. The adapter plates 7 and 7' have two sets of corresponding holes 12 and 12' and 13 and 13' to correspond with the holes in receiver member 39 of FIGS. 4 and 5. Receiver member 39, as shown in FIG. 4, has a pair of pivot points 27 and 28. The distance and location of said pivot points might vary from model to model of the backhoe being utilized. As shown in FIG. 2, two sets of tubular receptacles 14 and 14' and 15 and 15' are welded respectively to holes 12 and 12' and 13 and 13' of the adapter plates. The function of the tubular receptacles is to strengthen the areas where the adapter plates are to be connected to the receiver member and to improve the stability and stiffness of the connection of the forklift implement to the receiver member. The spacing between holes 12 and 13 and 12' and 13' is determined by the model and type of the receiver member. As shown in FIG. 3, with respect to the horizontal plane defined by tines 1 and 1', plate holes 13 and 13' are in a higher position than holes 12 and 12'. The vertical location and spacing of holes 12 and 13 and 12' and 13' are determined by the design of the receiver member since the distance between holes 12 and 13 and 12' and 13' must match the distance of pivot points 27 and 28. Said locations are also aimed at achieving a desired asset of the forklift with respect to the horizontal plane when attached to the backhoe. It should be noted that adapter plates 7 and 7' are mirror images of each other with the obvious exception of the threads of bores 9 and 9'.

FIG. 4 shows the forklift implement with the attached adapter plates on the ground ready to be attached to the backhoe boom.

The following is a general description of a backhoe boom which would be commercially available. Numerous variations of this single boom arrangement are known and would be equally suitable for use with the present invention. The backhoe design consists of a single boom that comprises a first arm 20 and a second arm 21. First arm 20 is attached to the vehicle via a pivot point 30 around the base of boom carrier 31. First arm 20 is functionally designed to be raised or lowered as part of the operation of the backhoe. The vertical movement is achieved by the connection of pivot point 42, located on first arm protrusion 48 which is offset from the axis connecting pivot points 23 and 30, to pivot point 29 on the boom carrier 31 via hydraulic piston 32. As piston 32 is retracted, pivot point 42 moves closer to pivot point 29 raising arm 20. The opposite effect occurs when piston 32 is lengthened by the operator via the boom control panel. Second arm 21 is connected to the first arm 20 at pivot point 23. The second arm is designed to rotate around pivot point 23 with the rotation being achieved by a second hydraulic piston 33 whose ends are connected to pivot points 42 and 22 respectively. The retraction or elongation of hydraulic piston 33 causes second arm 21 to rotate around pivot point 23. The coordinated operation of pistons 32 and 33 allows the end portion of arm 21 to move either in a vertical or horizontal direction depending on the input of the operator.

The end of second arm 21 opposite to pivot point 22 includes an arm extension member 49 which, depending on the model and manufacturer, is either solidly affixed to arm 21 generally along its main axis, or can be extended to increase the reach of the boom. The function of the arm extension member is to be connected to an implement such as bucket 41 and further provide the support and connection to the other components which allow the movement of the implement. The structure which allows the rotation of the connected implement on a generally vertical plane comprises a dual set of first tilt linkage member 37 and 37'. Member 37 is shown in detail in FIGS. 5(*a*) and 5(*b*). The corresponding member 37' on the opposite side of extension member 49 is hidden by member 37 in the lateral view of FIGS. 5(*a*) and 5(*b*). One end of said first tilt linkage members 37 and 37' is connected with arm extension member 49 at pivot point 25 with the other end connected to one end of second tilt linkage member 38 at pivot point 26. The opposite end of second tilt linkage member 38 is connected to receiver member 39 at pivot point 28.

Figure 10:
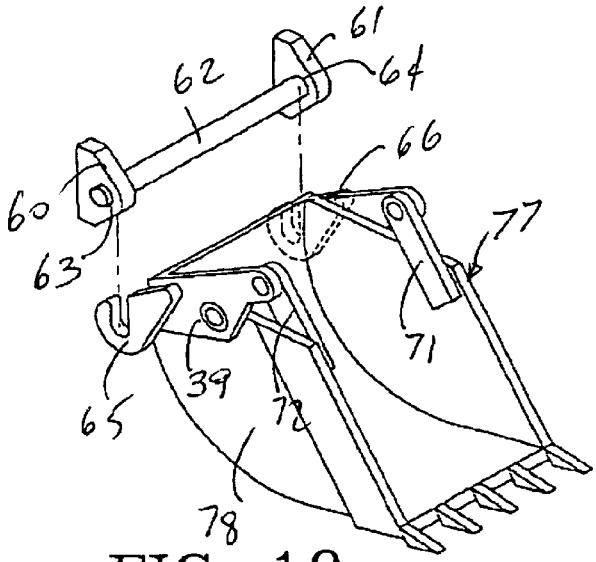
FIG. 10 shows the adapter rod attached to the forklift with its relative position to the adapter plates on the receiver member.

The generally u-shaped receiver member 39 as shown in FIG. 10 completes the boom assembly by connection to arm extension member 49 at pivot point 27 of FIG. 4 by means of pin 36. The central portion of the arms of the U is further connected to a second tilt linkage member 38 at pivot point 28 of FIG. 4 via pin 35 of FIG. 5(*b*). Pivot point 26 is connected to one end of hydraulic piston 34 of FIG. 5(*a*), while the other end of said piston 34 is connected to pivot point 24 on second arm 21. The extension or contraction of piston 34 causes the combination of the linkage members and the receiver member to rotate on a vertical plane. This rotation allows the operator to position and rotate the implement to achieve the desired task. The assembly and construction described above is representative of a single boom backhoe. The present invention could be utilized on a variety of other backhoe structures.

As shown in FIG. 4, if the backhoe boom is utilized to operate a bucket 41 of FIG. 4, the bucket is attached to receiver member 39 via bucket fasteners 50 which connect the bucket side walls 77 and 78 of FIG. 10 to the lower portions of the u-arms of the receiver member. Additionally, the bucket is connected to pivot points 28 via bucket pivot plates 71 and 72 of FIG. 10 to the corresponding holes in the upper portion of the u-arms of receiver member 39. Pin 36 corresponding to pivot point 27 thus connects the receiver member, the bucket pivot plates 71 and 72 and the arm extension member 49 to allow the bucket to rotate around pivot point 27.

Figure 5:
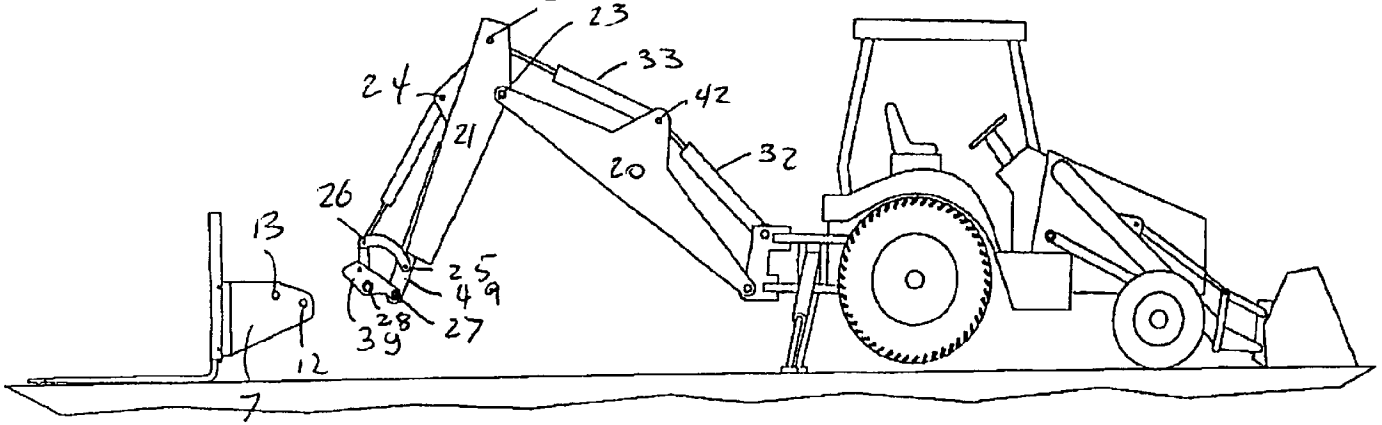
FIG. 5 is a lateral view of the tractor of FIG. 4 with the boom ready to be joined with the forklift implement.
Figure 5A:
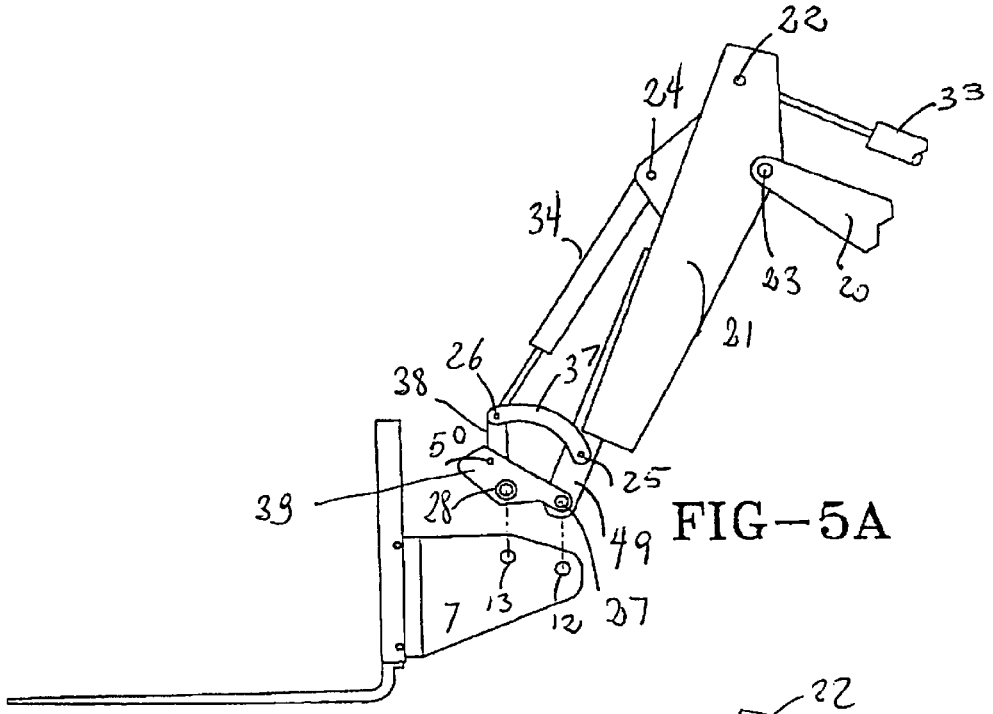
Figure 5B:
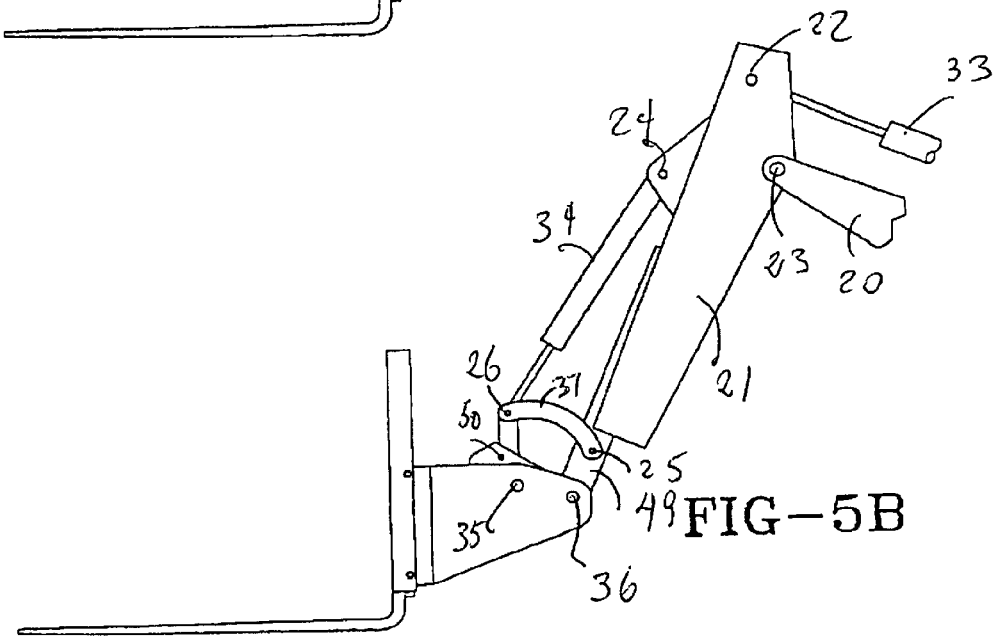
Figure 6:
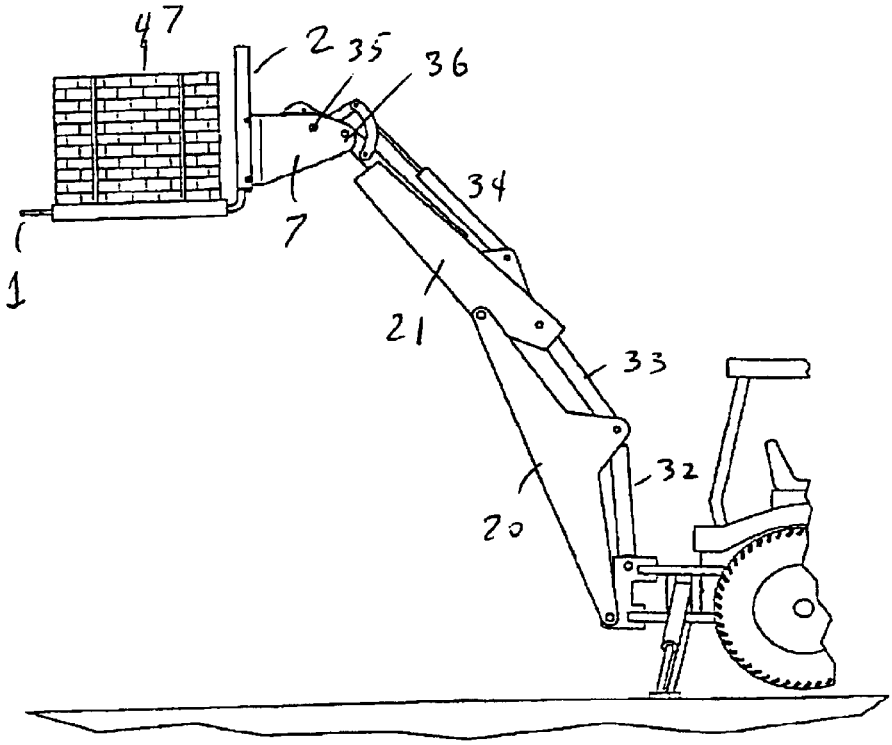
FIG. 6 is a lateral view of the backhoe boom and the forklift with a load in an elevated position.
Figure 7:
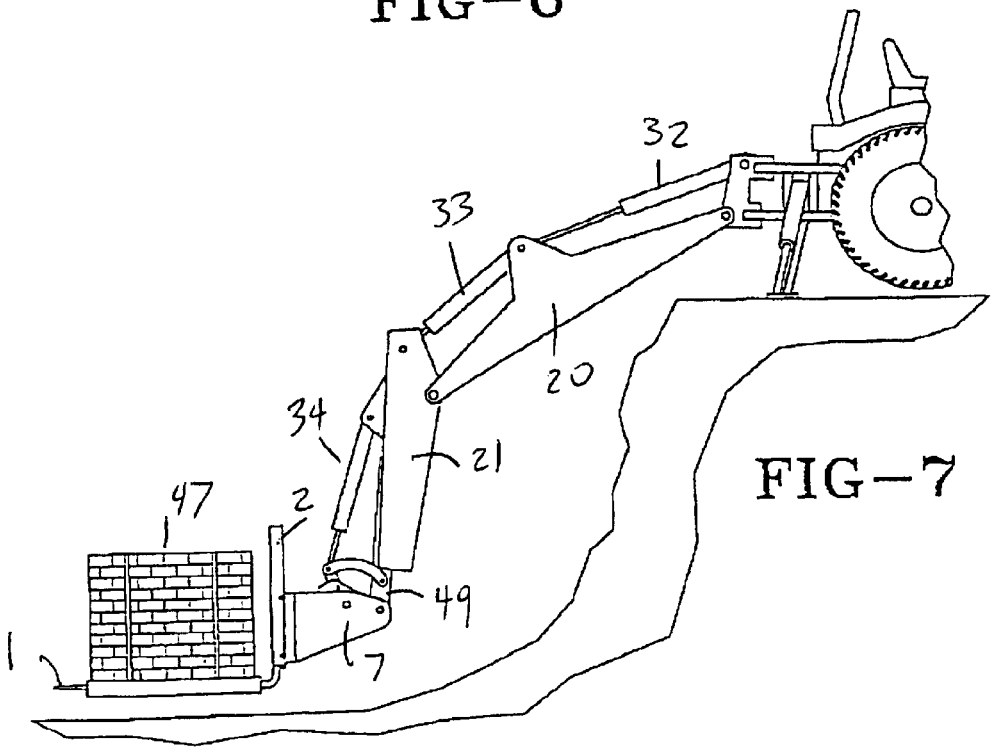
FIG. 7 is a lateral view of the boom with the forklift in a lower position.

In one preferred embodiment of the present invention, as shown in FIG. 5, the bucket 41 is removed to enable the attachment of the forklift implement as shown in FIGS. 5(*a*) and 5(*b*). The sets of holes 12 and 13 and 12 and 13 in the adapter plates 7 and 7' are spaced and located so as to correspond to the pivot holes 27 and 28 respectively in the receiver member 39. In the preferred embodiment the set of adapter plates 7 and 7' are spaced with respect to each other to receive the u-shaped receiver member 39 in the space between said plates, as modified by the attachment of tubular receptacles 14 and 14' and 15 and 15'. The adapter plates 7 and 7' are then easily connected to the receiver member by the insertion of pins 35 and 36 and the forklift is thus securely connected to the boom and can be raised or lowered as shown in FIGS. 6 and 7 to lift or lower a load 47.

Figure 8:
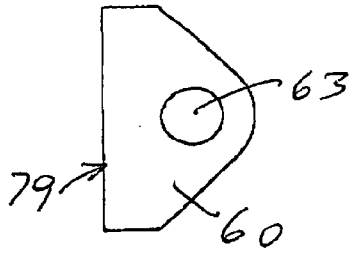
FIG. 8 shows a lateral view of an adapter holder for a rod.
Figure 9:
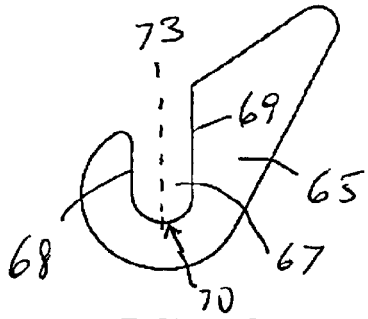
FIG. 9 shows a lateral view of the adapter plates to be attached to the receiver member of the backhoe.
Figure 11:
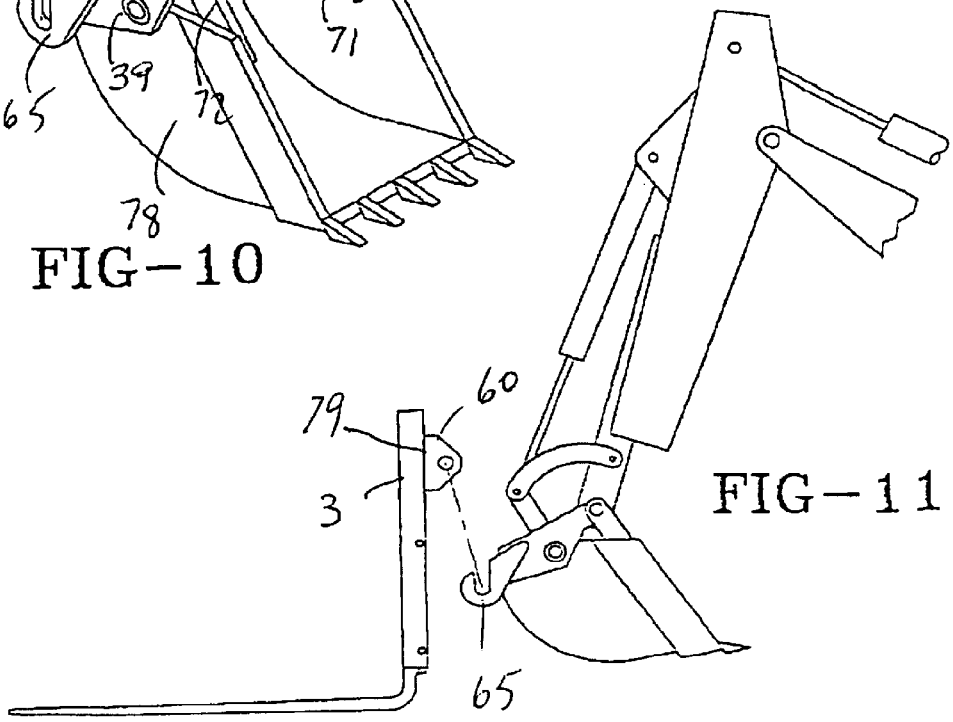
FIG. 11 shows the backhoe and bucket ready to engage with the forklift.

In another preferred embodiment the forklift implement is modified by attaching to upper back plate 3, as shown in FIG. 11, a set of rod support adapter members 60 and 61 of FIGS. 8 and 10. The rod support adapter members have a connection surface 79 which rests against the upper back plate 3. A connection can be achieved utilizing fasteners, welding or other connection means known in the art. The support adapter members have holes 63 and 64, as shown in FIG. 10, designed to receive a connection rod 62. The connection rod may be constructed by utilizing a suitable metal or other structural material and is dimensioned to withstand the loads to be carried by the forklift implement. Holes 63 and 64 are displaced from connection surface 79 sufficiently to allow adapter plates 65 and 66 of FIGS. 9 and 10 to clear the upper back plate while being engaged with connection rod 62. Adapter plates 65 and 66 are fastened to the outer portions of the arms of the u-shaped receiver member either in a permanent or detachable manner. FIG. 10 shows the adapter plates as being permanently affixed to the receiver member 39. The adapter plates comprise a hook throat 67, shown in FIG. 9, having a width sufficient to engage the diameter of connection rod 62. The hook throat comprises generally parallel walls 68 and 69 of FIG. 9 and a throat bottom 70. Axis 73 represents the axis of the hook throat.

Figure 12:
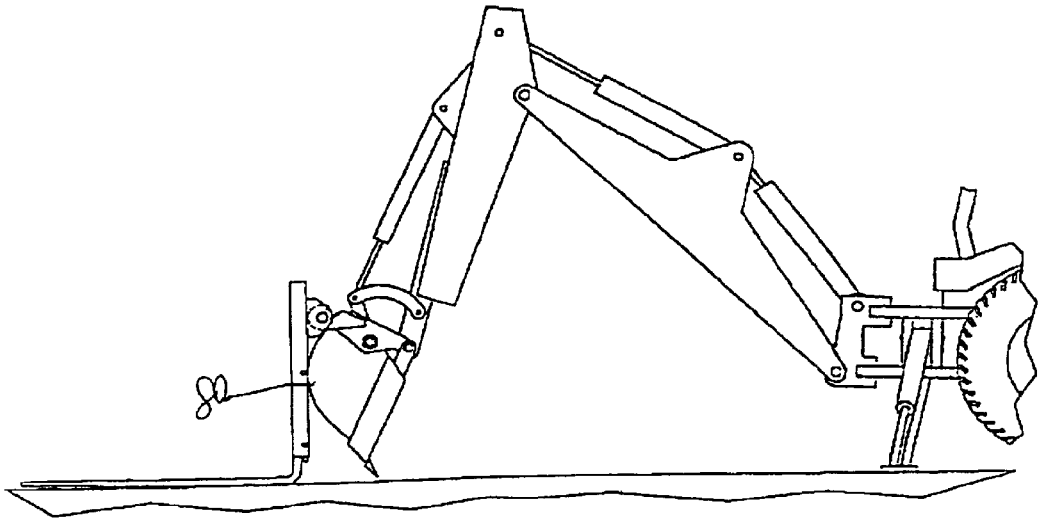
FIG. 12 shows the bucket forklift combination in a low position.
Figure 13:
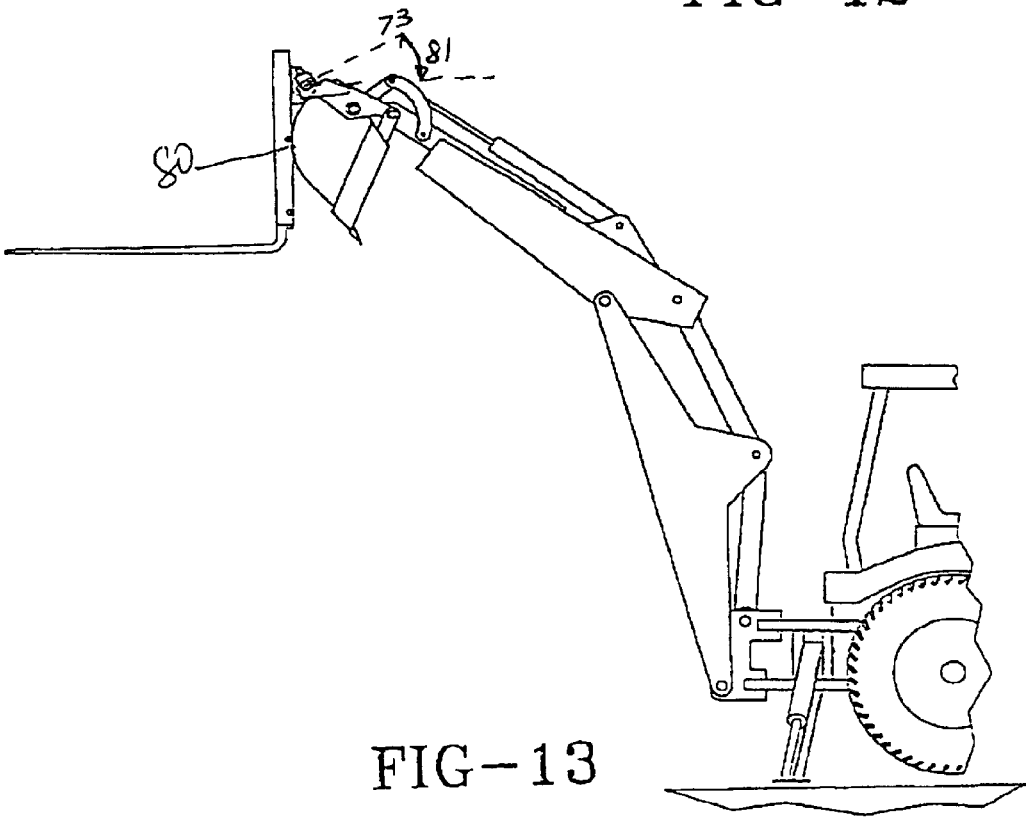
FIG. 13 shows the same combination in an elevated position.

As shown in FIG. 11, with the adapter plates affixed to the outside of the receiver member 39, the forklift implement can be connected to the boom by engaging the connection rod with the hook throats of the adapter plates. A significant advantage of this embodiment is that the fork implement can be engaged without removing the bucket and without the need for any additional manual connection. As shown in FIGS. 12 and 13, the adapter plates are affixed to the receiver member in such a manner so as to have the outside of the bucket bottom 80 contacting the upper or lower back plate to provide, in conjunction with the adapter plates, a three point support for the forklift implement. It should be noted, as shown in FIG. 13, that axis 73 of the hook throat is forming an acute angle 81 with the horizon when the forklift is in its normal operating position with its tines generally parallel to the ground. The direction of axis 73 assures that the forklift cannot detach itself from the boom while being operated by accidentally having the connection rod exiting the hook throats. Further, the contact of the outside of the bucket bottom 80 with the back plates results in complete stability of the forklift implement during operation.

The preferred embodiments have been described in detail, but variations and modifications may occur to those skilled in the art to which the invention pertains.

What is claimed is:

1. A forklift implement for connection to a bucket receiver member of a backhoe boom, the receiver member having two parallel arms, each arm having a first pair of holes, the implement comprising:

a) a back frame extending vertically and horizontally, and having a frontal and rear portion;

b) at least one back plate affixed to the rear portion of the back frame;

c) a set of tines attached to the frontal portion of the back frame extending outwardly in a generally perpendicular direction for holding a load;

d) a pair of symmetrical spaced apart vertical adapter plates having one end capable of being fastened perpendicularly to the back plate to project rearwardly with respect to the tines, said adapter plates being thicker in said one end for improving the horizontal stability of the adapter plates, said thicker ends of the adapter plates containing a plurality of threaded bores for receiving an equal plurality of threaded fasteners for fastening the adapter plates to the back plate positioned to correspond to the plurality of threaded bores;

e) a second pair of holes in each adapter plate, each pair of holes in one adapter plate being symmetrical to the pair of holes in the other adapter plate with respect to plane parallel to the adapter plates, with the holes of each pair being sufficiently displaced from each other to correspond to the first pair of holes in the arms of the receiver member; and f) a pair of cylindrical shafts for rigidly connecting holes in each adapter plate with the corresponding holes in the receiver member for rigidly connecting the forklift implement to the receiver member.

2. A forklift implement according to claim 1 and further including a tubular receptacle fastened to each hole in the adapter plates to increase the strength of the adapter plates in the area of the holes.

3. A forklift implement according to claim 2 wherein tubular receptacles are welded to the holes.

4. A forklift implement for use with a modified bucket receiver member of a backhoe boom, the implement comprising:

a) a back frame extending vertically and horizontally and having a frontal and a rear portion;

b) at least one back plate affixed to the rear portion of the back frame;

c) a set of at least one tine attached to the front portion of the back frame extending outwardly in a generally perpendicular direction for holding a load;

d) a pair of symmetrical spaced apart vertical rod support adapter members having one end being capable of being fastened perpendicularly to the rear portion of the back plate to project rearwardly with respect to the set of tines;

e) a hole in each rod support adapter member, each hole having a longitudinal axis perpendicular to the vertical plane of the rod support adapter member; and f) a connection rod connecting the holes in the rod support adapter members, said connection rod for connecting the forklift implement to a suitably modified bucket receiver member;

wherein said back plate has a portion located across said back frame and providing an abutting surface for contact by the bottom of the bucket when the forklift implement is connected to said connection rod to provide a three-point support for the forklift implement.

5. A bucket receiver member of a backhoe boom of a backhoe with a bucket attached to the backhoe boom, for use with a suitable forklift implement, said receiver member comprising:

a) a generally u-shaped rigid frame having a back portion member;

b) two equal length parallel arms, each arm having a free end and another end attached perpendicularly to a corresponding end of the back portion member;

c) two first holes each located towards the free end of each parallel arm, said first holes for pivotally connecting, via a first pivot shaft, the free ends of the parallel arms to a first pivot point located on an end arm of the backhoe boom;

d) two second holes each located on the corresponding parallel arm between the first hole and the end attached to the end of the back portion member, said second holes for pivotally connecting, via a second pivot shaft, the parallel arms to a first end of a combination of tilt linkage members having a second end operatively connected to an actuating piston for rotating said second pivot shaft around said first pivot point in a vertical direction; and e) two receiver adapter plates rigidly connected to the parallel arms of the receiver member proximally to the ends connected to the back portion member, said receiver adapter plates having sections protruding rearwardly of the back portion member, said sections comprising hook throats for engaging a forklift implement.

6. A bucket receiver member according to claim 5 wherein an acute angle is contained within the intersection of an axis along each hook throat and a line connecting the first hole and the second hole of each parallel arm.

7. A forklift implement for use in combination with a bucket receiver member of a backhoe boom, said forklift implement comprising:

a) a back frame extending vertically and horizontally and having a frontal and a rear portion;

b) at least one back plate affixed to the rear portion of the back frame;

c) a set of at least one tine attached to the front portion of the back frame extending outwardly in a generally perpendicular direction for holding a load;

d) a pair of symmetrical spaced apart vertical rod support adapter members having one end being capable of being fastened perpendicularly to the back plate to project rearwardly with respect to the set of tines;

e) a hole in each rod support adapter member, each hole having a longitudinal axis perpendicular to the vertical plane of the rod support adapter member; and f) a connection rod connecting the holes in the rod support adapter members; and said bucket receiver member comprising:

g) a generally u-shaped rigid frame having a back portion member;

h) two equal length parallel arms, each arm having a free end and another end attached perpendicularly to a corresponding end of the back portion member;

i) two first holes each located towards the free end of each parallel arm, said first holes for pivotally connecting, via a first pivot shaft, the free ends of the parallel arms to a first pivot point located on an end arm of the backhoe boom;

j) two second holes each located on the corresponding parallel arm between the first hole and the end attached to the end of the back portion member, said second holes for pivotally connecting, via a second pivot shaft, the parallel arms to a first end of a combination of tilt linkage members having a second end operatively connected to an actuating piston for rotating said second pivot shaft around said first pivot point in a vertical direction;

k) a bucket having a concave and a convex side, and an upper portion for connection to the bucket receiver member, the connection being achieved by the first pivot shaft being connected to the upper portion of the bucket towards the concave side and the second pivot shaft being connected to the upper portion towards the convex side of the bucket;

l) two receiver adapter plates rigidly connected to the parallel arms of the receiver member proximally to the ends connected to the back portion member, said receiver adapter plates having sections protruding rearwardly of the back portion member, said sections comprising hook throats for engaging the connection rod for lifting the forklift implement, said implement having a portion of the back plate abutting the convex side of the bucket for support during operation of the boom.

8. A bucket receiver member according to claim 7 wherein an acute angle is contained within the intersection of an axis along each hook throat and a line connecting the first hole and the second hole of each parallel arm.

* * * * *